United States Patent [19]

Horwinski

[11] 4,416,591

[45] Nov. 22, 1983

[54] RECIPROCAL PUMP WITH IMPROVED VALVE

[75] Inventor: E. Robert Horwinski, Cheshire, Conn.

[73] Assignee: Gulf & Western Manufacturing Company, Southfield, Mich.

[21] Appl. No.: 289,862

[22] Filed: Aug. 4, 1981

[51] Int. Cl.[3] ..... F04F 7/00; F04B 17/04; F04B 21/04

[52] U.S. Cl. ..... 417/241; 417/417; 417/566; 251/DIG. 3

[58] Field of Search ..... 417/550, 559, 566, 240, 417/241, 417; 251/DIG. 3

[56] References Cited

U.S. PATENT DOCUMENTS 1,688,237 10/1928 Joncha ..... 417/559
2,125,435 8/1938 Erling ..... 251/DIG. 3
2,872,871 2/1959 Allen ..... 417/550
3,610,279 10/1971 McIntosh et al. ..... 251/DIG. 3
3,884,447 5/1975 Alexander et al. ..... 251/DIG. 3

*Primary Examiner*—William L. Freeh
*Assistant Examiner*—Paul F. Neils
*Attorney, Agent, or Firm*—Body, Vickers & Daniels

[57] ABSTRACT

In a submersible pump of the type comprising a liquid inlet, a liquid outlet and an interconnecting valve chamber in which a valve member reciprocates to force liquid from the inlet to the outlet of the pump there is provided an improved valve member which uses a valve having an elongated body formed from a generally conical coil spring with abutting convolutions. The convolutions are opened when the valve member moves away from the pumping direction and closed when the valve member moves in the pumping direction.

53 Claims, 16 Drawing Figures

Fig. 5.
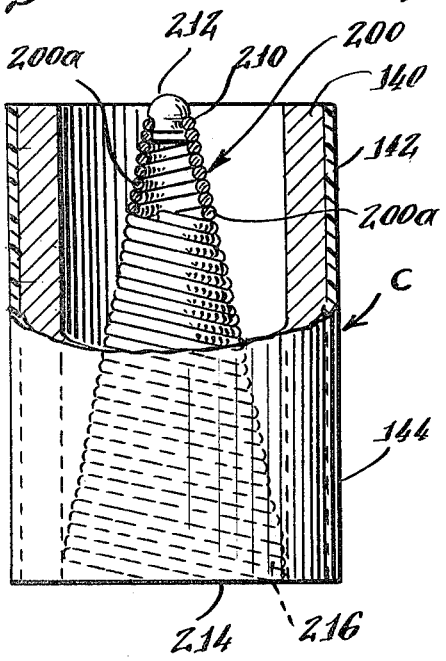
Fig. 6.
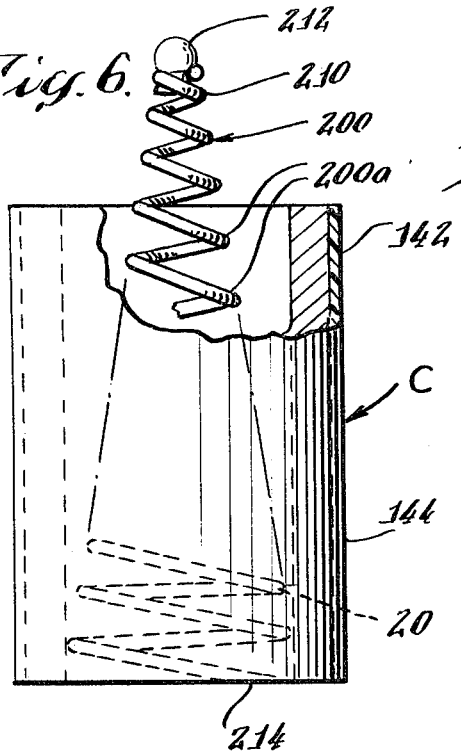
Fig. 7.
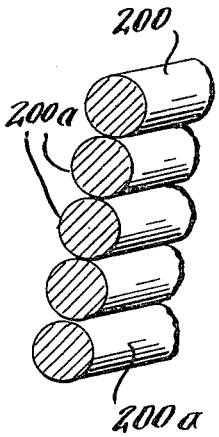
Fig. 8.
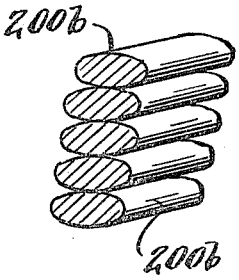
Fig. 9.
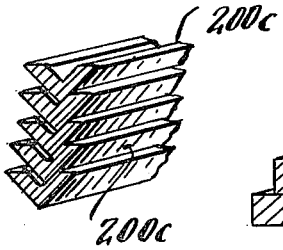
Fig. 10.
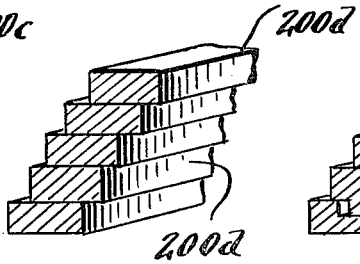
Fig. 11.
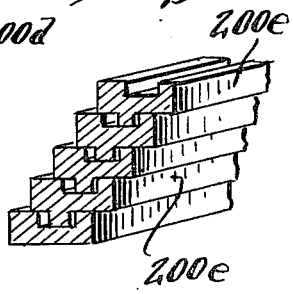
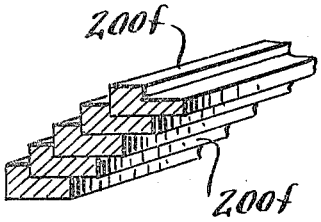
Fig. 12.
Fig. 13.
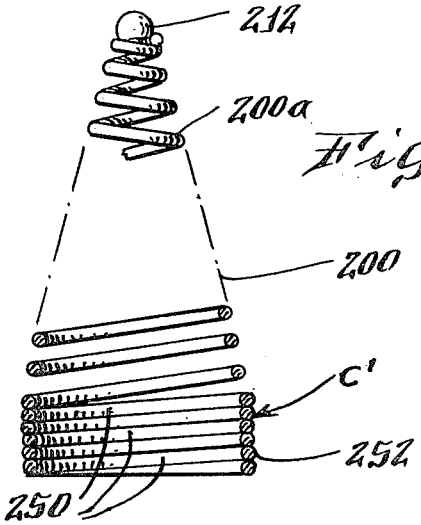

Fig. 14.
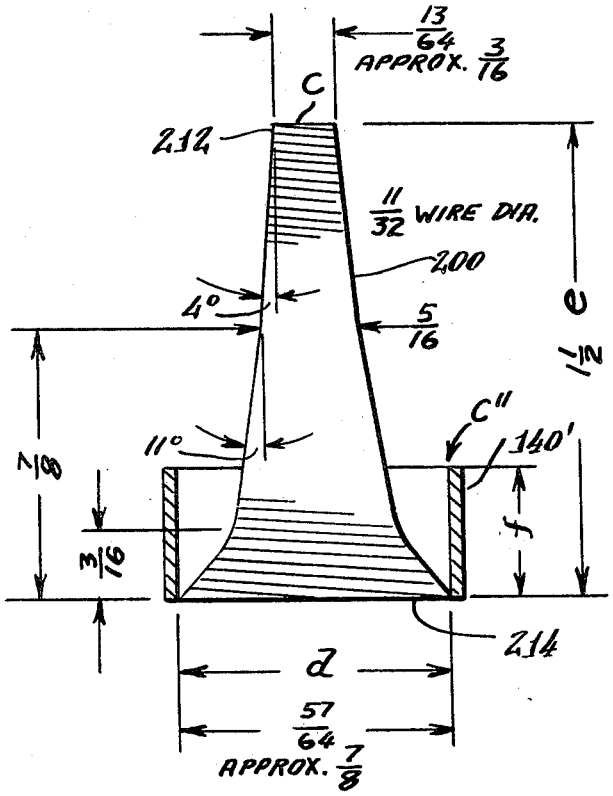
$d \geq 2c$ $\quad f < e$
$d = 4\text{–}8c$ $\quad f < \frac{e}{2}$
Fig. 15.
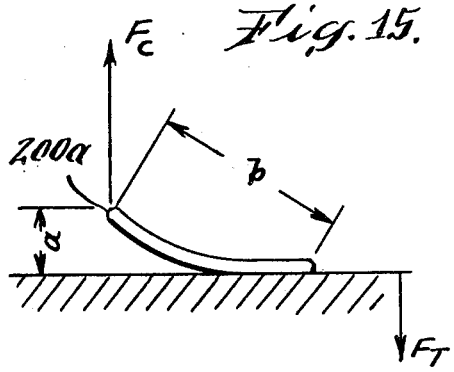
$F_c \sim m(a-b)$, acc & $P_i$
$\Sigma F_c = F_T$
$a \sim F_c$, b & $S_c$
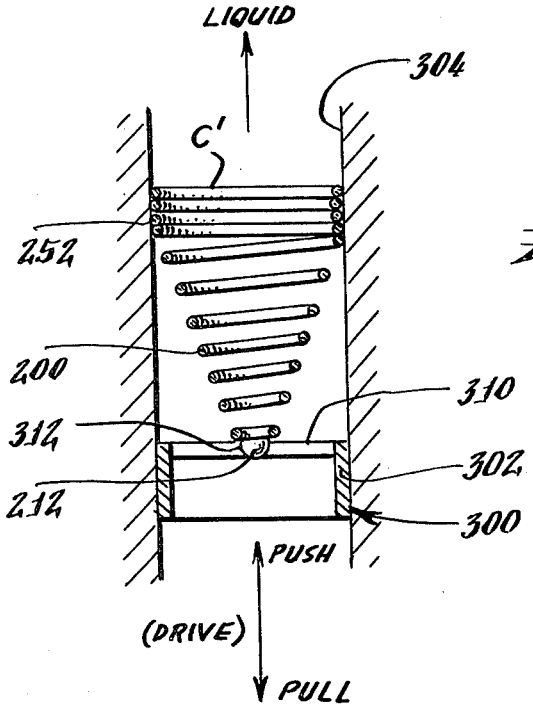
Fig. 16.

RECIPROCAL PUMP WITH IMPROVED VALVE

The present invention relates to the art of submersible pumps and more particularly to a submersible pump having an improved valve carried by a movable valve member.

BACKGROUND OF INVENTION

A submersible pump as defined herein relates to a pump wherein the inlet, outlet and interconnecting valve chambers are filled with liquid. Generally such pumps operate in a body of liquid. Submersible pumps are used in various applications, such as wells, boat bilges, septic tanks, chemical tanks, etc. Fuel lines for internal combustion engines retain a liquid filled pumping passage and can use a similar pump. In this application, the pump itself is not submerged; however, there is a continuous supply of liquid to the valve chamber so that it can act substantially as a pump fully submerged in a liquid. Submersible pumps have been developed with both rotary and reciprocal pumping mechanisms. The present invention relates to a reciprocal type pump and, more particularly, to an improved reciprocal valve member for use in such a pump. A valve member in this type of pump generally includes a valve which is closed when the valve member is forced in the exhaust or pumping direction and opened when the valve member is reciprocated into the intake direction. These valve members have used complex valves and have been relatively heavy. Consequently, the mechanism for driving the valve members, if high flow capacity is to be obtained, is correspondingly expensive and complex. Indeed, when flow or pumping capacities over about 100 gallons per hour are to be pumped, the submersible pumps have involved either rotary impellers or complicated valves on reciprocating valve members. These submersible pumps are not self-cleaning and become clogged, especially when used in adverse environments such as septic tanks and boat bilges.

THE INVENTION

The present invention relates to an improved valve member for use in a submersible pump of the type explained above, which valve member is inexpensive, lightweight, self-cleaning and drivable by a simplified reciprocal drive mechanism. By using this improved valve member, a submersible pump can be driven by a magnetic actuated motor and still obtain high capacities. In addition, the valve member is self-cleaning and can be used for pumping liquid laden with a variety of particulate materials. Consequently, the pump is particularly applicable for a bilge pump of a boat; however, the new valve member can operate in such critical areas as the gasoline line for a fuel injection system in an internal combustion engine. In this environment, the improved valve member is particularly useful because of its low weight, low driving energy, low generated heat and self-limiting output pressure.

In accordance with the present invention, there is provided an improvement in a pump of the type comprising a liquid filled passage including a liquid inlet, a liquid outlet and an interconnecting valve chamber, which pump includes a valve member movable in the valve chamber in a first direction from the inlet to the outlet and in a second direction from the outlet to the inlet. In this type of unit, the valve member carries a valve which is closed when the valve member is moved in the first direction and is opened when the valve member is moved in the second direction. By reciprocating the valve member alternately between the first and second directions liquid is forced through the liquid filled passage of the pump in a flow direction from the inlet of the pump to the outlet of the pump. There is provided an improved valve on the valve member. This improved valve has an elongated, generally hollow body extending axially in the flow direction of the pump and having a central cavity, a cap or cap portion extending in a first direction and cosing the cavity, a base or base portion facing in a second direction and a valve portion between the cap and base. In accordance with the invention, this valve portion is a coil spring formed into normally abutting convolutions with ever-increasing external diameters in a direction from the cap toward the base and with a spring constant which allows the convolutions to separate as the valve member is driven in the second or retracting position. Using this concept, a generally conical coil spring can be employed as the valve for the valve member reciprocated in a submersible pump.

When the valve member is driven in the exhaust direction, which corresponds to the extended direction of the valve, the convolutions are forced together by the back pressure and by the inertia of the valve. Thus, there is a positive driving action exerting exhaust force against the liquid in the valve chamber. When the valve member is pulled or driven in the opposite direction, the inertia on the coil spring and the pressure differential across the valve causes the convolutions to disengage allowing a free movement of the coil spring valve through the liquid in the direction from the outlet toward the inlet. This opening of the coil spring captures additional liquid on the opposite side of the coil spring which closes when the valve member stops. As the valve member is driven in the exhaust direction the conical coil spring which has closed is held in tight engagement by forces on the spring. Movement of the valve member drives the captured liquid in the exhaust direction. By using this concept, a reciprocal member carrying this valve can be driven by a magnetic arrangement so that a relatively simple valving operation is realized in the submersible pump. As the valve member is forced in one direction, the coil spring collapses and seals. When it is pulled in the other direction, it expands and unseals and then seals when stopped. This opening and closing of the coil spring, in the form of a cone or a general shape similar to a hyperboloid of revolution, causes self-cleaning, positive driving of the liquid and does not require lubrication. Thus, the force created by the magnetic driving arrangement for the unit is sufficiently converted to a pumping action. If the valve should become defective, it is a simple procedure to remove one valve member and replace it with another valve member. Thus, repair of the pump using the improved valve is quite simple. Since there is no lubrication required, no rotary parts, and no complex driving mechanism, the pump is not only low cost but also has an extended expected life.

In accordance with another aspect of the invention, there is provided an improved valving member, as defined above, which valve member carries a valve having an elongated, generally hollow body extending axially and having a central cavity, a cap closing the cavity, a base exposing the cavity and a valving portion in the form of a coil spring with normally abutting convolutions having ever-increasing external diameters in a direction from the cap toward the base and with a spring constant that allows the convolutions to separate as the valve member is driven in the intake direction.

The primary object of the present invention is the provision of a valve member for use in a reciprocal pump, which valve member includes an elongated, coil spring with normally closed convolutions that are opened when the spring is pulled in the intake direction and closed when the spring is at rest. The convolutions are forced tightly together when the member is pushed in the exhaust direction.

Still a further object of the present invention is the provision of a valve member as defined above, which valve member includes a conical coil spring which is pulled and pushed by one end thereof.

Still a further object of the present invention is the provision of a valve member, as defined above, which valve member is self-cleaning, relatively low in maintenance, and low in initial cost.

Yet another object of the present invention is the provision of a valve member, as defined above, which valve member can be reciprocated without complex driving mechanism, without a rotary action, or without special lubricating features.

Still a further object of the present invention is the provision of a valve member, as defined above, which valve member has a relatively extended life, is easily replaced, and is positive in its pumping action.

A further object of the present invention is the provision of an improved pump including the improved valve member as defined above.

These and other objects and advantages will become apparent from the following description taken together with the accompanying drawings.

BRIEF DESCRIPTION OF DRAWINGS

In the present disclosure, the following drawings are employed.

FIG. 5 is an enlarged, schematic view of the valve member and the improved valve carrier thereon in the rest position;

FIG. 6 is a view similar to FIG. 5 with the valve shown schematically in a condition representing the intake position of the valve;

FIG. 7 is a partial, enlarged cross-sectional view illustrating the preferred convolutions of the present invention;

FIGS. 8–12 are modifications of the cross-sectional shape of the spring convolutions for a valve in accordance with the present invention;

FIG. 13 is a side elevational view of another preferred embodiment of the present invention;

FIG. 14 is a graphic view of the valve and valve member employing a different shape for the coil spring;

FIG. 15 is a schematic layout view illustrating the operating characteristics of the present invention; and, FIG. 16 is a partial side view of a further modification of the preferred embodiment.

PREFERRED EMBODIMENTS

Figure 1:
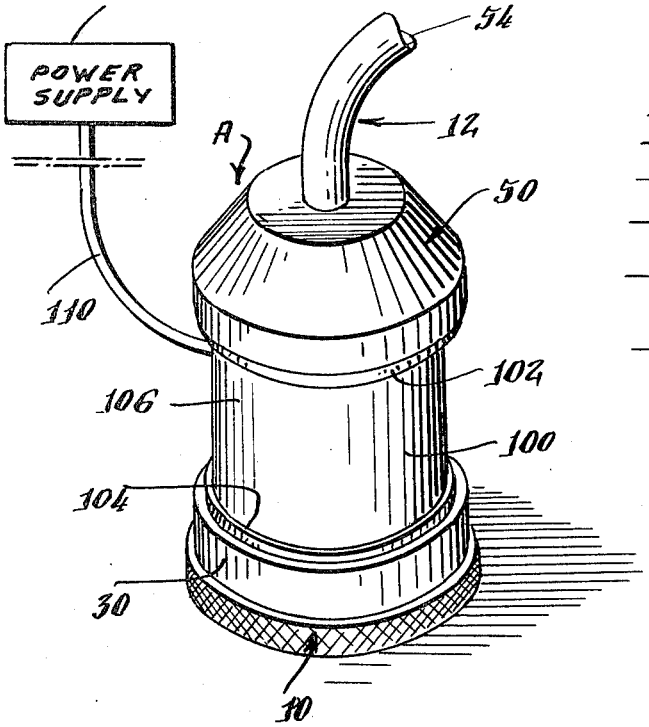
FIG. 1 is a pictorial view of a submersible pump constructed in accordance with the preferred embodiment of the present invention.
Figure 2:
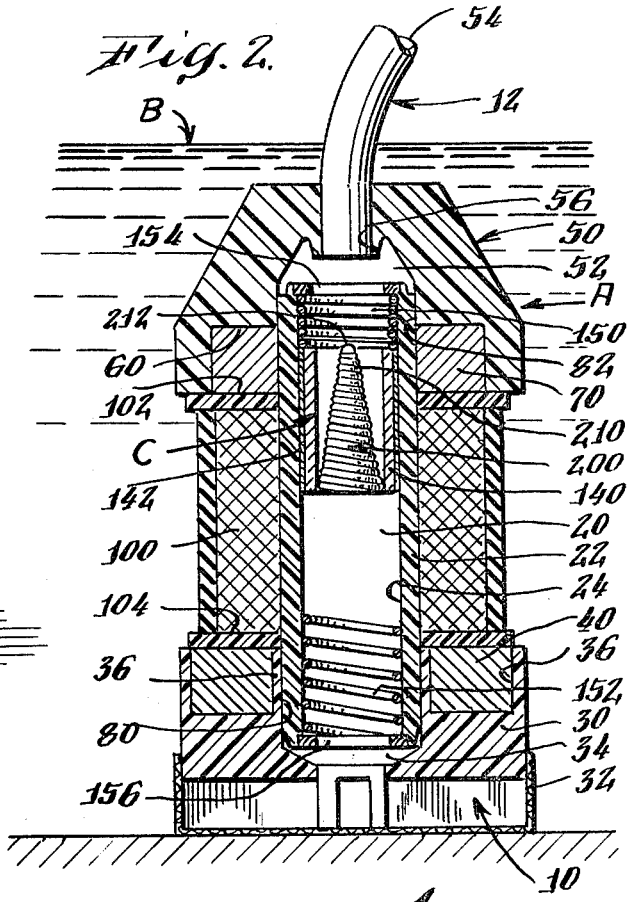
FIG. 2 is an enlarged cross-sectional view of the preferred embodiment illustrated in FIG. 1.

Referring now to FIGS. 1–4, a submerged pump A is adapted to operate in a liquid B and has an internal, reciprocally mounted valve member C which is employed to pump liquid from inlet 10 through outlet 12. Reciprocation of valve member C, by appropriate magnetic arrangement to be described later, maintains a flow of liquid B through pump A. In accordance with the preferred embodiment of the invention, pump A includes a central valve chamber 20 formed by a cylindrical teflon sleeve 22 having an internal cylindrical bearing surfce 24 adapted to receive reciprocating valve member C. Valve chamber 20 combines with the inlet and outlet to form a liquid passage through pump P which passage is filled with a liquid during the operation of pump A. A support base 30 is generally cylindrical and is formed from a non-magnetic material, such as aluminum, zinc, bronze, etc. This support base forms a lower intake cavity which is covered by a screen 32. Liquid passes through screen 32 and into inlet port 34. A generally toroidal recess 36 receives a permanent magnet ring 40 having appropriate polarization in an axial direction, as illustrated in FIG. 2. Valve member C is formed of magnetically permeable material such as iron and is magnetically attracted by magnet 40. An upper cap 50 is formed also from a non-magnetic material and includes an outlet port 52 to be connected with line 54 secured by an appropriate coupling 56. This structure forms outlet 12 of pump A. In submersible pump A, it may be advantageous to incorporate a one-way check valve which valve allows passage of liquid from outlet 12 but does not allow liquid to flow into valve chamber 20 from the outlet. Such a check valve could be incorporated within coupling 56. A recess 60 in cap 50 is adapted to receive a second permanent magnet ring 70 being polarized in an axial direction, as indicated. By using two magnets 40, 70, reciprocating valve member C has two attracted, at rest positions. One position is adjacent inlet 10. The other position is adjacent outlet 12. In practice, member C is alternatively snapped between the upper and lower positions to cause a pumping action. It is conceivable that one permanent magnet could be employed to bias valve member C in a selected, at rest position. In the preferred embodiment, two permanent magnets are employed to bias or pull valve member C in both directions. Support sleeve 22 in valve chamber 20 extends between support base 30 and axially spaced cap 50. Appropriate bores 80, 82 receive the opposite ends of support sleeve 22 and are dimensioned to allow sufficient spacing to accommodate a somewhat standard solenoid coil 100. This solenoid coil encircles teflon sleeve 22 and is spaced from cap 50 by teflon end ring or cap 102 and from support base 30 by teflon end ring or cap 104. A cylindrical outer cover 106 protects solenoid coil 100 from exposure to liquid B. By using the teflon elements, solenoid coil 100 can be sealed.

In accordance with the illustrated embodiment, solenoid coil 100 includes power leads 110 connected to appropriate power supply 120. This power supply can be pulsating D.C. or A.C. according to the desired operating characteristics for reciprocating valve member C. The power supply and details of pulsing coil 100 are known in the art and do not form a part of this invention. In the preferred arrangement, a 12 volt supply voltage creates pulses of opposite polarity to shift valve member C from the up position shown in FIGS. 2 and 4 to the down position shown in FIG. 3.

Figure 3:
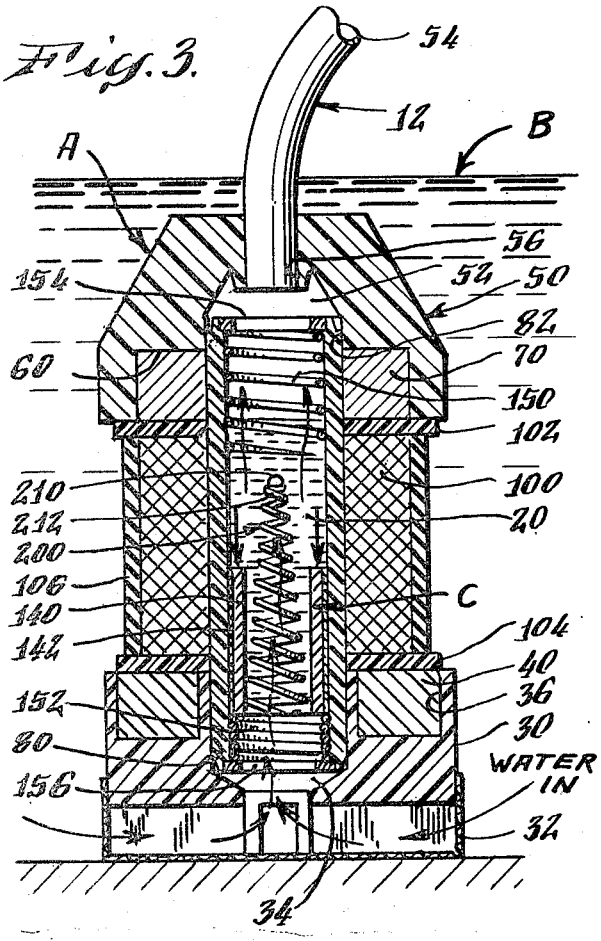
FIG. 3 is a view similar to FIG. 2 showing the valve member being pulled in the intake direction.
Figure 4:
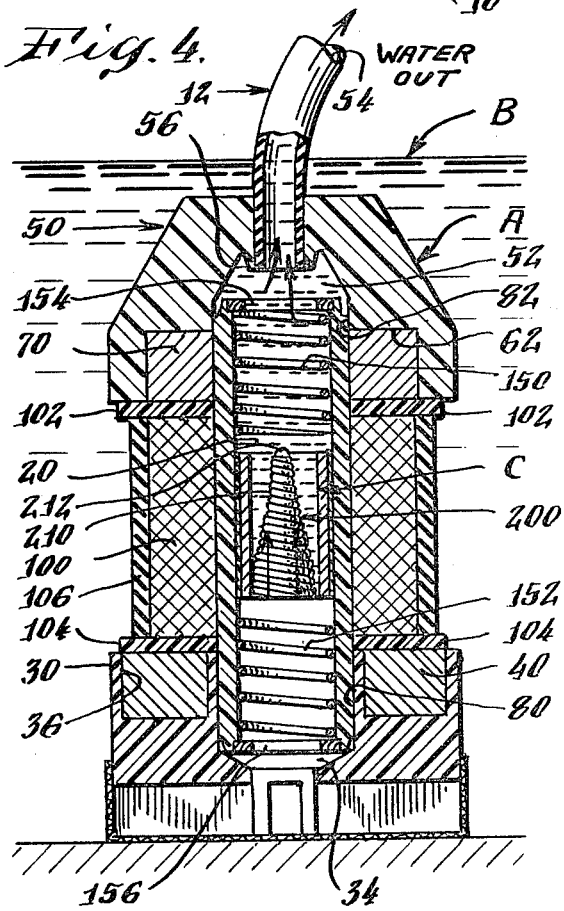
FIG. 4 is a view similar to FIG. 2 showing the valve member being driven or pushed in the exhaust or pumping direction.

Referring now to FIGS. 5–7, valve member C includes a magnetically permeable sleeve 140 with an outer teflon sleeve or coating 142. This sleeve or coating defines an outer cylindrical surface 144 slidably engaging surface 24. These two surfaces allow reciprocal movement of member C by solenoid coil 100. Coil spring bumpers 150, 152 are held with respect to sleeve 22 by an appropriate structure illustrated as shoulders and snap rings 154, 156. In accordance with the present invention, a hollow coil spring 200 is used as a valve for valve member C. This spring, as shown in FIGS. 5–7, includes convolutions 200*a* which are ever-increasing in size from the upper free end 210 which is closed by a cap 212 to a base 214. Spring 200 is generally conical in shape and has engaging adjacent convolutions 200*a* which are offset from each other to assure proper sealing when valve member C is moved in the exhaust direction and to reduce resistance when the spring is pulled in the intake direction. To do this, adjacent convolutions 200*a* are offset from each other by at least 5° and preferably between 5°–20°. Thus, there is positive sealing action when valve member C is moved into the pumping or exhaust direction as shown in FIG. 4. An appropriate joint shown as a solder joint 216 is used to connect the lower base 214 of spring valve 200 with the lower end of sleeve 140. Cap 212, which may be a body of solder or a machined cap, closes conical spring 200 to create an interior chamber or cavity 220. This cavity is closed during reciprocation of spring 200 in the exhaust direction. During this action, sleeve 140 pushes spring 200 toward the exhaust direction. The differential in pressure together with the weight of the spring and the weight of cap 212 tightly forces adjacent convolutions 200*a* into a sealing contact shown in FIGS. 4, 5, and 7. When solenoid coil 100 drives valve member C in the opposite direction, as shown in FIG. 3, the intertia of the spring 200 and cap 212 coact with the pressure differential to open the internal chamber or cavity 220 by spreading at least the lower convolutions of a spring 200. This opening action is sudden and drastic to allow valve member C to be driven through the liquid in chamber 20 in the direction shown in FIG. 3. There is only a minor frictional drag against sleeve 22 and liquid drag on spring 200. The opening of the convolutions during the movement of valve member C allows the valve member to move downwardly into the lowermost position. When it reaches this position, cap 212 and spring 20 continue to move downwardly by inertia. This closes the spring cavity 220 when member C is in the lower rest position. Thereafter, valve member C is driven upwardly by coil 100 to an upper rest position. This drives the closed spring 200 in an upper direction as shown in FIG. 4. This action causes a pressure to be applied to force liquid in chamber 20 through outlet 12. When the cycle is repeated, member C is driven downwardly. This immediately opens the convolutions, as shown in FIGS. 3 and 6, to allow movement of valve 200 through the liquid in chamber 20. At this position, the spring again retracts to close chamber 220 for the next power or exhaust stroke. As can be seen, by connecting conical valve 200 at its base 214, sleeve 140 pulls spring 200 downward to open the convolutions. In the opposite direction, spring 200 is pushed by base 214. This clamps the adjacent convolutions and causes a leak-free power stroke.

As so far described, adjacent convolutions 200*a* are circular in cross-section and offset slightly to cause a tight sealing action during the power stroke, as shown in FIG. 7. To increase this sealing action, the cross-section of the various adjacent convolutions can be changed. These modifications are shown in FIGS. 8–12 wherein convolutions 200*b*–200*f* are illustrated. In accordance with FIG. 8, the convolutions 200*b* are elliptical in cross-section. In FIG. 9, the convolutions 200*c* are generally V-shaped in cross-section. In FIG. 10, the cross-sections of adjacent convolutions 200*b* is generally rectangular. The tongue and groove concept is employed for convolutions 200*e* in FIG. 11. An L-shaped cross-section is shown for adjacent convolutions 200*f* in FIG. 12. In the embodiment shown in FIGS. 9, 11 and 12, the interaction of adjacent convolutions tightly seals the inner chamber 220 of spring 200 by an overlapping joint. This assists in the sealing action caused by the pressure differential and the intertia realized during the power stroke of valve member C.

A further modification of the present invention is illustrated in FIG. 13 wherein conical coil spring 200 includes a plurality of convolutions 250 adjacent base portion 214 to form the valve member C′. These convolutions have the same size and are soldered together to form an outer cylindrical wall 252 that takes the place of sleeve 140, as shown in FIGS. 5 and 6. The outer surface could be coated with teflon. In this embodiment, coil spring 200 is formed from a magnetic material to cause the reciprocating action previously described. In FIGS. 5 and 6, it is preferred that spring 200 is formed of non-magnetic material, such as bronze, so that the magnetic action of coil 100 and permanent magnet rings 40, 70 have no interaction with the operation of coil spring 200.

Referring now to FIG. 14, another preferred embodiment of the invention is illustrated wherein spring 200, having a cap 212 and a base 214, is generally in the form of a hyperboloid of revolution. In this shape the upper portion has a relatively small angle, illustrated as about 4°, and the lower portion has a relatively large angle, illustrated as about 11°. In this embodiment, valve member C″ is relatively short and has an axial length f. Sleeve 140′ is formed in substantially the same manner as previously described sleeve 140; however, its length is substantially shorter than the height e of spring 200. In practice, the axial length f is less than one-half of the height e. In this manner, the weight of member C with coil spring 200 connected is substantially reduced to reduce the inertia of the total unit. The basic weight of the assembly of member C″ and valve 200 is provided by cap 212 which is at least about 50% of the total assembled weight. Thus, when valve member C″ is pulled in the downward direction by a force $F_T$, the weight of cap 212 immediately spreads the convolutions 200*a*, at least in the lower portion of spring 200. The inertia of cap 212 has a tendency to stretch the spring to open the convolutions rapidly. In the opposite direction, force $F_R$ acts against the inertia of cap 212 so that the cap positively forces the adjacent convolutions to remain closed to provide a positive sealing action during the exhaust stroke of valve member C″. By employing a conical spring 200, the upper portion at cap 212 has a smaller profile than the lower portion at base 214. This provides free flow of liquid through the spring when the convolutions are opened. If these two elements were approximatley the same size, the downward movement of member C or member C″, as shown in FIG. 14, would have a tendency to pump liquid by the upper cap into the reverse direction from inlet 10. To prevent this action, the cap 12 is relatively small in profile and has a relatively high weight to cause rapid opening of the convolutions when the valve member is driven in the downward direction, as shown in FIG. 3. In FIG. 14, the dimension d is the diameter of lower base 214. This diameter is greater than two times the diameter c of upper cap 212. In practice, diameter d is between four and eight times the diameter c of cap 212.

In FIG. 15, a general operating characteristic of the present invention is illustrated wherein one of the convolutions 200*a* is schematically illustrated in a transverse direction with the force $F_T$ being applied to one end thereof. This occurs during movement of spring 200 in the direction shown in FIG. 3 when preparing for the next power stroke. The spacing a illustrates the amount of opening between adjacent convolutions, one of which is shown in FIG. 14. The convolutions has a length b, which can be a diameter or an actual circumferential length. As can be seen, the spacing between convolutions, or openings a, is generally controlled by the reaction force $F_C$ on the convolution 200*a* and the length or size of convolution b taken together with the spring constant $S_c$ of spring 200. The force $F_C$ is a function of the mass above convolution 200*a*, the acceleration of spring 200 and the pressure differential applied across the convolution. The relationships schematically illustrated in FIG. 15 indicate that the lower convolutions of spring 200 will be open more than the upper convolutions. As a greater force $F_T$ is applied, there is greater acceleration which will cause all convolutions to open a greater distance and have larger openings a. The summation of all the forces $F_C$ on each of the convolutions will equal the total force $F_T$ applied at base 214 of spring 200. Of course, the convolutions 200*a* of spring 200 are formed spirally and are individualized only in a cross-sectional nature. As can be seen, the inertia of cap 214 and spring 200 causes a rapid opening at the convolutions 200*a* to allow movement of spring 200 in the downward direction shown in FIG. 3. In this manner, spring 200 passes through the water with minor liquid resistance due to the small profile of cap 212. In the lower position, the convolutions of spring 200 seek their normal positions and close. Thereafte, coil 100 forces spring 200 upwardly by driving valve member C, C′ or C″ in the upward direction, as shown in FIG. 4.

In FIG. 16, another configuration is illustrated. Valve member 300 has a skirt 302 reciprocated in cylinder 304 by a pulling and pushing action as already described. An open spider 310 has a central portion 312 connected to cap 212 of valving member C′ as shown in FIG. 13. Wall 252 reciprocates with respect to member 300 in cylinder 304. In this manner, valve 200 is inverse; however, it will still operate as previously described. This modification is shown for illustrative purposes only.

Having thus described the invention, the following is claimed:

1. A valve member for a pump of the type having a liquid filled passage including a liquid inlet, a liquid outlet and an interconnecting valve chamber wherein said valve member is movable in a first direction from said inlet to said outlet and in a second direction from said outlet to said inlet, said valve member including a valve carried thereon and closed when said member is moving in said first direction and opened when said member is moving in said second direction, said valve having an elongated, generally hollow body extending axially and having a central cavity, a cap portion closing said cavity, a base portion exposing said cavity and a valving portion between said cap portion and base portion, said valving portion being a coil spring formed into normally abutting convolutions with ever-increasing external diameters in a direction from said cap toward said base and with a spring contant which allows said convolutions to separate as said valve member is driven in said second direction.

2. A valve member as defined in claim 1 wherein said cap portion has a transverse diameter and said base portion has a transverse diameter, wherein said base diameter is at least twice said cap diameter.

3. A valve member as defined in claim 1 wherein said cap portion is a weight increasing member and has a substantial weight compared with the remainder of said valve.

4. A valve member as defined in claim 1 wherein said member has a generally cylindrical support sleeve and an outer cylindrical bearing surface and said chamber includes a cylindrical bearing wall with said surface and said wall adapted for reciprocally mounting said valve member in said chamber.

5. A valve member for a pump of the type having a liquid filled passage including a liquid inlet, a liquid output and an inteconnecting valve chamber wherein said valve member is movable in a first direction from said inlet to said outlet and in a second direction from said outlet to said inlet, said valve member including a valve carried thereon and closed when said valve member is moving in said first direction and opened when said valve member is moving in said second direction, said valve having an elongated, generally hollow body extending axially and having a central cavity, a cap portion extending in said first direction and closing said cavity, a base facing said second direction and exposing said cavity and a valving portion between said cap and base, said valving portion being a coil spring formed into normally abutting convolutions with ever-increasing external diameters in a direction from said cap toward said base and with a spring constant which allows said convolutions to separate as said valve member is driven in said second direction.

6. A valve member as defined in claim 5 wherein said cap has a transverse diameter and said base has a transverse diameter, wherein said base diameter is at least twice said cap diameter.

7. A valve member as defined in claim 5 wherein said cap is a weight increasing member and has a substantial weight compared with the remainder of said valve.

8. A valve member as defined in claim 5 wherein said ever-increasing external diameter are in a non-linear relationship.

9. A valve member as defined in claim 5 wherein said convolutions are non-circular in cross-section.

10. A valve member as defined in claim 9 wherein said cross-section is generally elliptical.

11. A valve member as defined in claim 9 wherein said cross-section is generally rectangular.

12. A valve member as defined in claim 5 wherein said member has a cylindrical support sleeve and an outer cylindrical bearing surface and said chamber includes a cylindrical bearing wall with said surface and said wall reciprocally mounting said valve member in said chamber.

13. A valve member as defined in claim 12 wherein said support sleeve has a length and said valve has an axial length with said support sleeve length being substantially less than said valve length.

14. The improvement as defined in claim 12 wherein said valving portion is generally hyperbolic and diverges from said cap portion.

15. A valve member as defined in claim 12 wherein said support sleeve member is formed from convolutions of a coil spring which convolutions are generally of the same diameter and are held in abutting relationship.

16. A valve member as defined in claim 15 wherein said valve and support sleeve member are made from a continuous coil spring.

17. A valve member as defined in claim 12 wherein said valving portion is frusto-conical and diverges from said cap portion.

18. A valve member as defined in claim 17 wherein the amount of divergence is at least 5°.

19. A valve member as defined in claim 17 wherein the amount of divergence is in the general range of 5°–20°.

20. In a pump comprising a liquid filled passage including a liquid inlet, a liquid outlet and an interconnecting valve chamber, a valve member movable in said chamber in a first direction from said inlet to said outlet and in a second direction from said outlet to said inlet, a valve carried by said valve member and closed when said member is moving in said first direction and opened when said member is moving in said second direction and means for moving said valve member alternately between said first and second directions whereby liquid is moved through said liquid filled passage in a flow direction from said inlet to said outlet, the improvement comprising: said valve having an elongated, generally hollow body extending axially in said flow direction and having a central cavity, a cap portion in one of said directions and closing said cavity, a base portion facing in the other of said directions and exposing said cavity to said liquid passage and a valving portion between said cap and base, said valving portion being a coil spring formed into normally abutting convolutions with ever-increasing external diameters in a direction from said cap toward said base and with a spring constant which allows said convolutions to separate as said valve member is driven in said second direction, said valve being connected to said valve member at said portion facing said inlet direction and the other of said portions being movable with respect to said connecting portion.

21. The improvement as defined in claim 20 further including at least one bumper member in said chamber and engageble by said valve member as it is driven in said first direction.

22. The improvement as defined in claim 20 wherein said ever-increasing external diameters are in a non-linear relationship.

23. The improvement as defined in claim 20 wherein said valving portion profile is generally hyperbolic and diverges in said second direction.

24. The improvement as defined in claim 20 wherein said valve member is magnetically permeable and said reciprocating means involves a magnetic drive unit operable on said valve member.

25. The improvement as defined in claim 20 wherein said cap has a transverse diameter and said base has a transverse diameter, wherein said base diameter is at least twice said cap diameter.

26. The improvement as defined in claim 25 wherein said base diameter is at least approximately four times said cap diameter.

27. The improvement as defined in claim 20 wherein said valving portion is frusto-conical and diverges in said second direction.

28. The improvement as defined in claim 27 wherein the amount of divergence is at least 5°.

29. The improvement as defined in claim 27 wherein the amount of divergence is in the general range of 5°–20°.

30. The improvement as defined in claim 1 wherein said cap is a weight increasing member and has a substantial weight compared with the remainder of said valve.

31. The improvement as defined in claim 30 wherein said cap has a transverse diameter and said base has a transverse diameter, wherein said base diameter is at least twice said cap diameter.

32. The improvement as defined in claim 30 wherein said cap has a weight greater than the remainder of said valve.

33. The improvement as defined in claim 32 wherein said cap has a transverse diameter and said base has a transverse diameter, wherein said base diameter is at least twice said cap diameter.

34. The improvement as defined in claim 20 wherein said convolutions are non-circular in cross-section.

35. The improvement as defined in claim 34 wherein said cross-section is generally elliptical.

36. The improvement as defined in claim 34 wherein said cross-section is generally rectangular.

37. The improvement as defined in claim 34 wherein said cross-section includes a groove.

38. The improvement as defined in claim 37 wherein said groove faces said first direction.

39. The improvement as defined in claim 20 wherein said valve member has a cylindrical support sleeve, and an outer cylindrical bearing surface and said chamber includes a cylindrical bearing wall concentric with said flow direction, said surface and said wall reciprocally mounting said valve member in said chamber.

40. The improvement as defined in claim 39 further including at least one bumper member in said chamber and engageable by said valve member as it is driven in said first direction.

41. The improvement as defined in claim 39 wherein said outer cylindrical bearing surface is coextensive with said valving portion of said valve.

42. The improvement as defined in claim 39 wherein said support sleeve has a length in said flow direction and said valve has an axial length with said support sleeve length being substantially less than said valve length.

43. The improvement as defined in claim 42 wherein said support sleeve length is less than about one half of said valve length.

44. The improvement as defined in claim 39 wherein said cap has a transverse diameter and said base has a transverse diameter, wherein said base diameter is at least twice said cap diameter.

45. The improvement as defined in claim 4 wherein said base diameter is at least approximately four times said cap diameter.

46. The improvement as defined in claim 39 wherein said cap is a weight increasing member and has a substantial weight compared with the remainder of said valve.

47. The improvement as defined in claim 46 wherein said cap has a weight greater than the remainder of said valve.

48. The improvement as defined in claim 39 wherein said support sleeve is formed from convolutions of a coil spring which colvutions are generally of the same diameter and are held in abutting relationship.

49. The improvement as defined in claim 48 wherein said valve and support sleeve are made from a continuous coil spring.

50. The improvement as defined in claim 49 wherein said support sleeve has a length in said flow direction and said valve has an axial length with said support sleeve length being substantially less than said valve length.

51. The improvement as defined in claim 50 wherein said support sleeve length is less than about one half of said valve length.

52. In a pump comprising a liquid filled passage including a liquid inlet, a liquid outlet and an interconnecting valve chamber, a valve member movable in said chamber in a first direction from said inlet to said outlet and in a second direction from said outlet to said inlet, a valve carried by said valve member and closed when said member is moving in said first direction and opened when said member is moving in said second direction and means for reciprocating said valve member alternately between said first and second directions whereby liquid is moved through said liquid filled passage in a flow direction from said inlet to said outlet, the improvement comprising: said valve being a hollow coil spring with a closed unsupported end and an opened base connected to said valve member and exposing the interior of said spring to the inlet of said pump and said coil spring having a spring constant so that as said spring is pulled by its base toward the inlet, the convolutions of the spring are opened and as said spring is pushed by its base toward the outlet, the convolutions are forced together sealing the interior of the spring.

53. The improvement as defined in claim 52 wherein said coil spring is generally conical and diverging from said unsupported end to said opened base.

* * * * *